United States Patent [19]

Hinata et al.

[11] 3,967,967

[45] July 6, 1976

[54] SPECTRALLY SENSITIZED SILVER HALIDE PHOTOGRAPHIC EMULSION

[75] Inventors: Masanao Hinata; Haruo Takei; Akira Sato; Atsuo Iwamoto, all of Minami-ashigara, Japan

[73] Assignee: Fuji Photo Film Co., Ltd., Minami-ashigara, Japan

[22] Filed: Dec. 6, 1974

[21] Appl. No.: 530,102

[30] Foreign Application Priority Data

Dec. 6, 1973 Japan ..... 48-138344

[52] U.S. Cl. ..... 96/124; 96/137

[51] Int. Cl.[2] ..... G03C 1/14

[58] Field of Search ..... 96/124, 137

[56] References Cited

UNITED STATES PATENTS

| | | | |
|---|---|---|---|
| 3,177,210 | 4/1965 | Rosenoff | 96/137 |
| 3,338,714 | 8/1967 | Ficken et al. | 96/124 |
| 3,463,640 | 8/1969 | Ficken et al. | 96/124 |
| 3,615,609 | 10/1971 | Fry et al. | 96/124 |
| 3,679,428 | 7/1972 | Shiba et al. | 96/124 |

*Primary Examiner*—J. Travis Brown

*Attorney, Agent, or Firm*—Sughrue, Rothwell, Mion, Zinn & Macpeak

[57] ABSTRACT

A silver halide photographic emulsion containing, in combination, supersensitizing amounts of at least two carbocyanine dyes having structures hereinafter defined.

10 Claims, 6 Drawing Figures

SPECTRALLY SENSITIZED SILVER HALIDE PHOTOGRAPHIC EMULSION

BACKGROUND OF THE INVENTION

1. Field of the Invention

This invention relates to a silver halide photographic emulsion spectrally sensitized with at least two sensitizing dyes having supersensitizing effects on each other, and more specifically, to a silver halide photographic emulsion having increased spectral sensitivity in the red wavelength region.

One well-known technique of producing photographic materials is a spectrally sensitizing process by which the sensitive wavelength region of a silver halide photographic emulsion is broadened to a longer wavelength region by adding a certain kind of cyanine dye. It is generally known that the spectral sensitivity of a silver halide photographic emulsion is affected by the chemical structure of the sensitizing dye and the various characteristics of the emulsion such as the halogen composition of the silver halide, the crystal habit, the crystal system, the silver ion concentration of the hydrogen ion concentration, and also by photographic additives present in the emulsion, such as stabilizers, anti-foggants, coating assistants, precipitating agents, or color couplers.

Generally, only one sensitizing dye is used to sensitize a photographic emulsion to a specific spectral wavelength region. When such sensitizing dyes are used in combination, the sensitivity obtained is often lower than that obtained by using the sensitizing dyes individually. However, in some special cases, the spectral sensitivity obtained with a combination of two or more sensitizing dyes markedly increases. This kind of sensitization is known as "supersensitization". A precise selection of sensitizing dyes used in combination, however, is required since a slight difference in chemical structure can markedly affect the supersensitizing effect of the dyes employed. Accordingly, appropriate combinations of sensitizing dyes having supersensitizing effects are difficult to predict from consideration of their chemical structural formulas only.

Generally, the sensitizing effect of a dye on a certain emulsion can be varied by changing the emulsion characteristics. For example, the sensitizing activity can be increased by increasing the silver ion concentration, or by decreasing the hydrogen ion concentration, or by employing both of these techniques. The sensitizing activity can, therefore, be increased by immersing a film coated with the spectrally sensitized emulsion in water or an aqueous solution of ammonia. The above method by which the sensitivity of a sensitized emulsion is changed by increasing the silver ion concentration or decreasing the hydrogen ion concentration or by both of these techniques is usually called "hypersensitization". Hypersensitized emulsions generally have a short storage life.

When supersensitization is applied to a silver halide photograhic emulsion, the sensitizing dye must not have adverse interactions on photographic additives other than the sensitizing dyes, and stable photographic properties must be maintained even during the storage of the photographic materials. A further requirement of the sensitizing dyes used is that no "residual coloration" due to the sensitizing dyes must remain in the photographic materials after processing. This requirement is especially important when the photograhic materials are processed rapidly within short periods of time (usually several seconds to up to about 1 minute).

In order to obtain excellent color reproducibility in a color photographic material, the red sensitive layer preferably does not have a high sensitivity at too long a wavelength, for example, at wavelengths longer than 660 nm (the wavelength at which sensitization is maximum), and preferably does not have a sensitivity at too short a wavelength, for example, at wavelengths shorter than 580 nm (at which sensitization is maximum). According to spectral sensitizing techniques, it is difficult to increase the sensitivity in a wavelength region not exceeding about 630 nm (the wavelength at which sensitization is maximum). Among all, it is particularly difficult to increase the sensitivity in the wavelength region ranging from about 580 nm to 630 nm, and therefore, to solve this problem is one of the important subjects in the art.

SUMMARY OF THE INVENTION

Accordingly, a primary object of this invention is to provide a spectrally sensitized silver halide photographic emulsion having an especially high sensitivity in the wavelength region described above with scarcely any residual coloration remaining after processing.

A second object of this invention is to provide a color photographic emulsion in which the decrease in sensitivity generally occurring when a spectrally sensitizing dye and a cyan coupler are used in combination is reduced.

A third object of this invention is to provide a multilayered photographic emulsion in which the adjacent photographic layers are not sensitized due to the diffusion of a spectrally sensitizing dye.

A fourth object of this invention is to provide a photographic emulsion, in which the decrease in sensitivity generally occurring during the passage of time from the production of the photographic emulsion is reduced.

These objects are achieved with a silver halide photographic emulsion containing, in combination, supersensitizing amounts of (A) at least one sensitizing dye of the general formula (I)

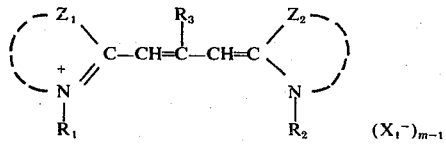

(I)

wherein $Z_1$ represents an atomic group required to form a benzimidazole ring which may be substituted with a substituent that does not deteriorate sensitivity, for example, a halogen atom such as a chlorine, bromine or fluorine atom, an alkoxycarbonyl group, e.g., having 1 to 4 carbon atoms in the alkyl moiety thereof such as a methoxycarbonyl, ethoxycarbonyl or butoxycarbonyl group, or an alkylcarbonyl group, e.g., having 1 to 4 carbon atoms in the alkyl moiety thereof such as a methylcarbonyl group; $Z_2$ represents an atomic group required to form a benzoselenazole ring which may be substituted with a substitutent that does not deteriorate sensitivity, for example, a halogen atom such as a chlorine or bromine atom, an alkyl group, e.g., having 1 to 4 carbon atoms such as a methyl or ethyl group, a hydroxyl group, or an alkoxy group, e.g., having 1 to 4 carbon atoms in the alkyl moiety thereof such as a methoxy group; $R_1$ and $R_2$ each represents a saturated or unsaturated aliphatic group with at least one of $R_1$ and $R_2$ being a carboxy-containing alkyl group or sulfo-containing alkyl group; $R_3$ represents a hydrogen atom or alkyl group; $X_1$ is an acid anion; $m$ is 1 or 2, and $n$ is 1 when the dye forms an intramolecular salt (of a betaine-like structure); and (B) at least one sensitizing dye selected from the group consisting of a sensitizing dye of the general formula (II)

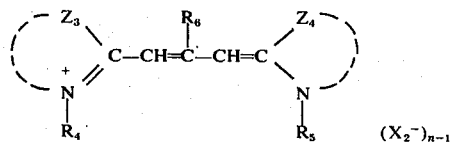

(II)

wherein $Z_3$ represents an atomic group required to form a benzothiazole ring, a β-naphthothiazole ring or a β-naphthoselenazole ring which may be substituted with a substituent that does not deteriorate sensitivity, for example, a halogen atom such as a chlorine, bromine or fluorine atom, an alkyl group, e.g., having 1 to 4 carbon atoms such as a methyl, ethyl or trifluoromethyl group, an aryl group such as a phenyl group, an acyl group such as an acetyl or benzyl group, a carbamoyl group such as an unsubstituted carbamoyl group or an alkyl (e.g., having 1 to 4 carbon atoms in the alkyl moiety thereof such as ethyl substituted) carbamoyl group, an alkoxy group, e.g., having 1 to 4 carbon atoms in the alkyl moiety thereof such as a methoxy group, an alkylcarbonyl group, e.g., having 1 to 4 carbon atoms in the alkyl moiety thereof such as a methylcarbonyl group, a carboxyl group, a hydroxyl group, or a cyano group; $Z_4$ represents an atomic group required to form a benzoimidazole ring which may be substituted with a substituent that does not deteriorate sensitivity (for example, those substitutents described with regard to $Z_1$); $R_4$ and $R_5$ each represents a saturated or unsaturated aliphatic group with at least one of $R_4$ and $R_5$ being a carboxy-containing alkyl group or a sulfo-containing alkyl group; $R_6$ represents a hydrogen atom or an alkyl group; $X_2$is an acid anion; $n$ is 1 or 2, and $n$ is 1 when the dye forms an intramolecular salt; and a sensitizing dye of the general formula (III)

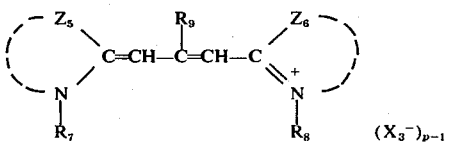

(III)

wherein $Z_5$ represents an atomic group required to form a benzothiazole ring or a benzoselenazole ring which may be substituted with a substituent that does not deteriorate sensitivity (for example, those substituents described with regard to $Z_2$ or $Z_3$); $Z_6$ represents an atomic group required to form a benzoxazole ring which may be substituted with a substituent that does not deteriorate sensitivity, for example, a halogen atom such as a chlorine, bromine of fluorine atom, an alkyl group, e.g., having 1 to 4 carbon atoms such as a methyl or trichloromethyl group, an alkoxy group, e.g., having 1 to 4 carbon atoms in the alkyl moiety thereof such as a methoxy group, an aryl group such as a phenyl group, a carboxyl group, or a carboxyalkyl group, e.g., having 1 to 4 carbon atoms in the alkyl moiety thereof such as a carboxymethyl group; $R_7$ and $R_8$ each represents a saturated or unsaturated aliphatic group with at least one of $R_7$ and $R_8$ being a carboxy-containing alkyl group or a sulfo-containing alkyl group; $R_9$ represents a hydrogen atom or an alkyl group; $X_3$ is an acid anion; and $p$ is 1 or 2, and $p$ is 1 when the dye forms an intramolecular salt.

DETAILED DESCRIPTION OF THE INVENTION

Figure 1:
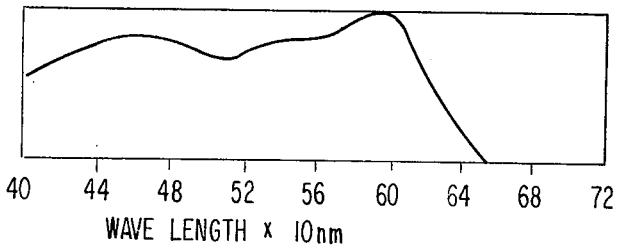
FIGS. 1 to 5 show the spectral sensitivity curves obtained in Run Nos. 2, 4, 7, 8 and 9 in the Example.

In the general formulae (I), (II) and (III) representing the sensitizing dyes used in this invention, examples of $Z_1$ and $Z_4$ are benzimidazole rings which contain at its 1-position an alkyl group (for example, an unsubstituted alkyl group such as a methyl or ethyl group, or an alkyl group substituted with a sulfo group, a hydroxyl group or an acetoxy group), an allyl group or an aryl group such as a phenyl group, and specifically include 1-methyl-5-chlorobenzimidazole, 1-methyl-5-fluorobenzimidazole, 1-methyl-5,6-dichlorobenzimidazole, 1-methyl-5,6-difluorobenzimidazole, 1-ethyl-5-chlorobenzimidazole, 1-ethyl-5-fluorobenzimidazole, 1-ethyl-5,6-dichlorobenzimidazole, 1-ethyl-5,6-difluorobenzimidazole, 1-propyl-5-chlorobenzimidazole, 1-propyl-5-fluorobenzimidazole, 1-propyl-5,6-dichlorobenzimidazole, 1-propyl-5,6-difluorobenzimidazole, 1-allyl-5-chlorobenzimidazole, 1-allyl-5-fluorobenzimidazole, 1-allyl-5,6-dichlorobenzimidazole, 1-allyl-5,6-difluorobenzimidazole, 1-phenyl-5-chlorobenzimidazole, 1-phenyl-5-fluorobenzimidazole, 1-phenyl-5,6-dichlorobenzimidazole and 1-phenyl-5,6-difluorobenzimidazole rings.

Examples of heterocyclic rings formed by $Z_2$ are benzoselenazole, 5-chlorobenzoselenazole, 5-bromobenzoselenazole, 5-methylbenzoselenazole, 5-methoxybenzoselenazole and 5,6-dimethylbenzoselenazole rings.

Examples of heterocyclic rings formed by $Z_3$ include benzothiazole, 5-chlorobenzothiazole, 5-bromobenzothiazole, 5-fluorobenzothiazole, 5-methylbenzothiazole, 5-methoxybenzothiazole, 5-methylcarbonylbenzothiazole, 5-ethoxybenzothiazole, 5-carboxybenzothiazole, 5-hydroxybenzothiazole, 5-trifluoromethylbenzothiazole, 5-cyanobenzothiazole, 5,6-dimethylbenzothiazole, 5,6-dimethoxybenzothiazole, 5,6-dichlorobenzothiazole, β-naphthothiazole and β-naphthoselenazole rings.

Examples of heterocyclic rings formed by $Z_5$ are the same benzothiazole rings described for $Z_3$, either substituted or unsubstituted, and benzoselenazole rings, either substituted or unsubstituted, as described above for $Z_2$.

Examples of heterocyclic rings formed by $Z_6$ include benzoxazole, 5-fluorobenzoxazole, 5-chlorobenzoxazole, 5-bromobenzoxazole, 5-trifluoromethylbenzoxazole, 5-methylbenzoxazole, 5,6-dimethylbenzoxazole, 5-methoxybenzoxazole, 5,6-dimethoxybenzoxazole, 5-phenylbenzoxazole, 5-carboxybenzoxazole and 5-carboxymethylbenzoxazole rings.

$R_3$, $R_6$ and $R_9$ each represents, for example, a hydrogen atom or an alkyl group, e.g., having 1 to 4 carbon atoms such as a methyl, ethyl or propyl group.

Examples of suitable groups for $R_1$, $R_2$, $R_4$, $R_5$, $R_7$ and $R_8$ are unsubstituted alkyl groups, e.g., having 1 to 4 carbon atoms such as a metyl, ethyl or propyl group, substituted alkyl groups, e.g., having 1 to 8 carbon atoms and 1 to 4 carbon atoms in the alkyl moiety thereof such as a hydroxyalkyl group (e.g., a 2-hydroxyethyl or 3-hydroxypropyl group), a carboxy-containing alkyl group such as a carboxyalkyl group (e.g., a 2-carboxyethyl, 3-carboxypropyl, or 4-carboxybutyl group), a carboxy-alkoxy-substituted alkyl group (e.g., a 2-(2-carboxyethoxy)-ethyl group), a sulfo-containing alkyl group such as a sulfoalkyl group (e.g., a 2-sulfoethyl or 3-sulfopropyl group), a sulfo-alkoxy-substituted alkyl group such as a 2-(3-sulfopropoxy)ethyl or 3-sulfopropoxyethyl group), a sulfohydroxy-substituted alkyl group such as a 2-hydroxy-3-sulfopropyl group, and a vinylmethyl group.

$X_1$, $X_2$ and $X_3$ are acid anions used for conventional cyanine dye salts, such as an iodide, bromide, chloride, p-toluenesulfonate, benzenesulfonate, sulfate, perchlorate, and thiocyanate ion.

The supersensitizing technique in accordance with this invention is useful for producing emulsions for coupler-incorporated color photographic materials of a multilayered structure, particularly emulsions for reversal color or negative color films, micronegative color films, or high speed negative films.

Some specific examples of the sensitizing dyes which can be used in this invention are given below. It should be understood, however, that the invention is not to be construed as being limited to these specific examples.

Examples of dyes of the general formula (I) are the following dyes.

(I-A)

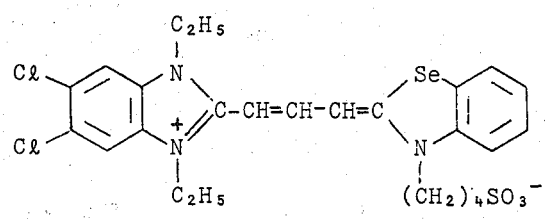

(I-B)

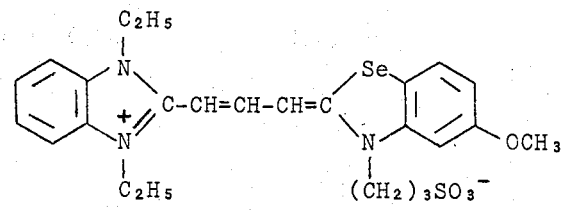

(I-C)

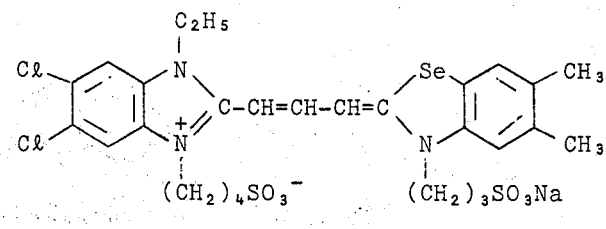

(I-D)

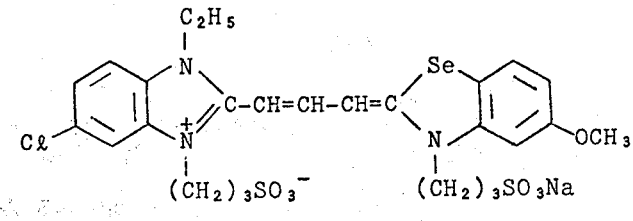

(I-E)
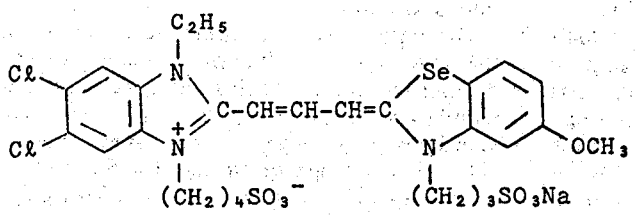
(I-F)
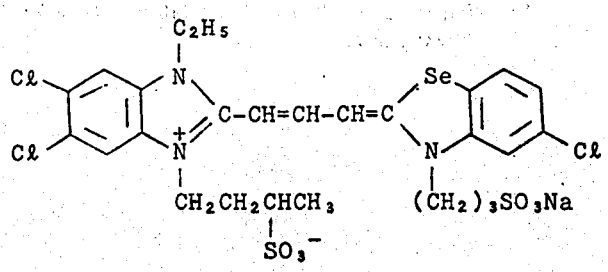
(I-G)
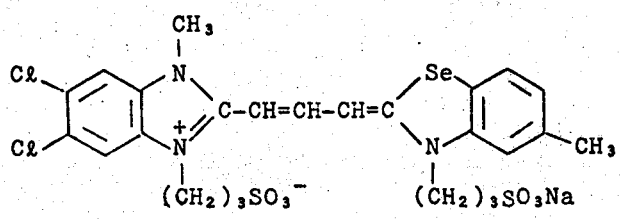
(I-H)
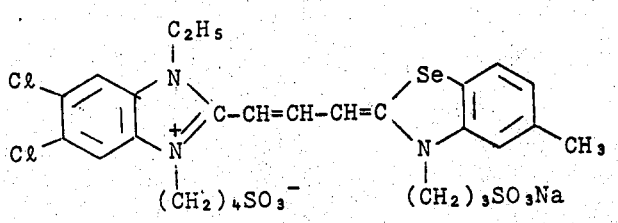
(I-I)
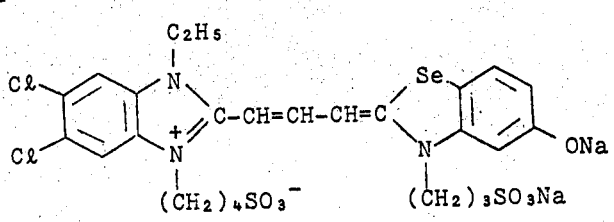

(I-J)
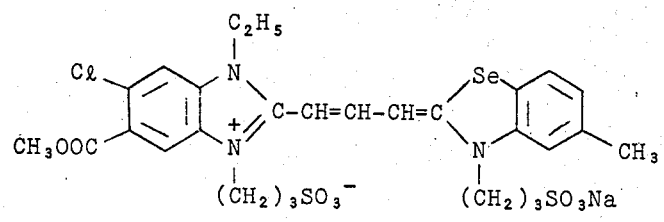
(I-K)
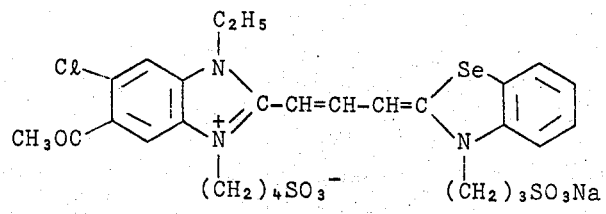
Examples of dyes of the general formula (II) are the following dyes.
(II-A)
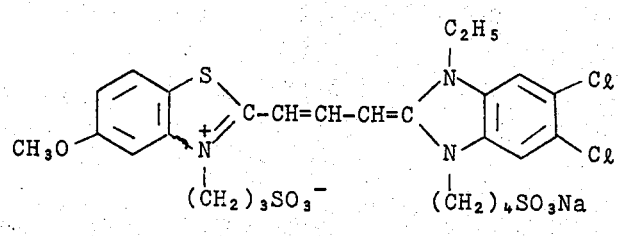
(II-B)
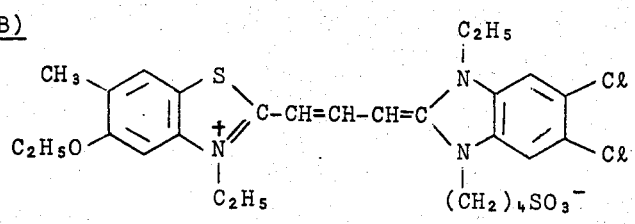
(II-C)
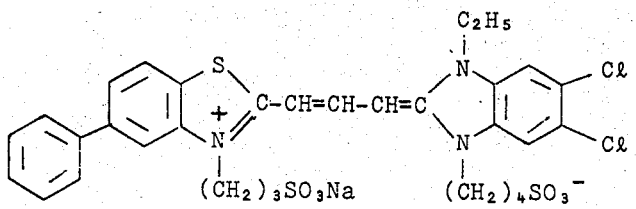
(II-D)
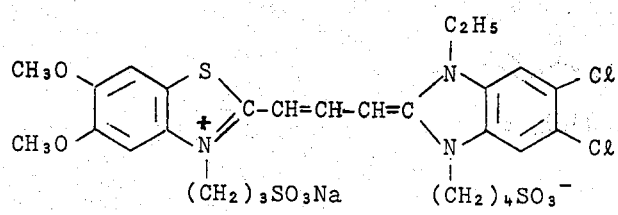

(II-E)
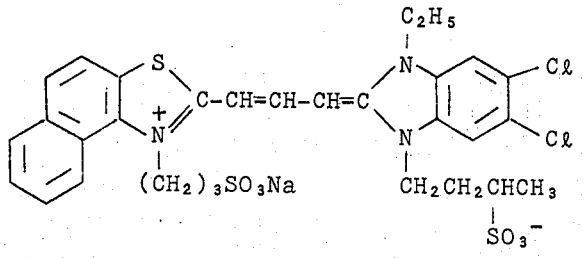
(II-F)
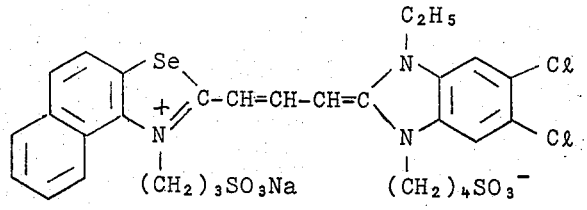
(II-G)
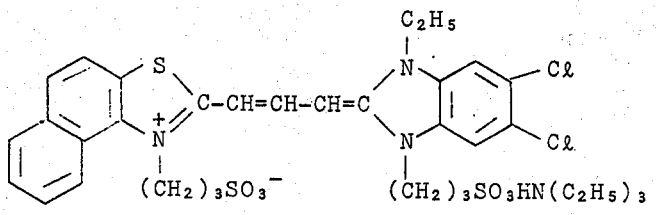
(II-H)
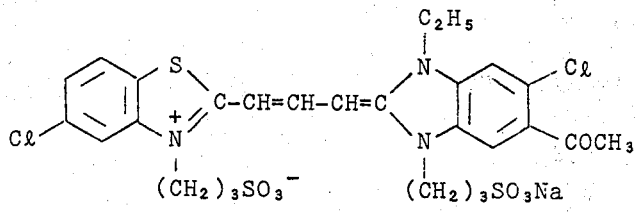
(II-I)
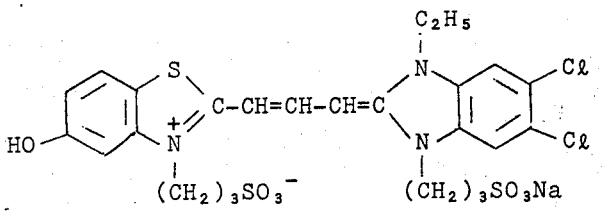
(II-J)
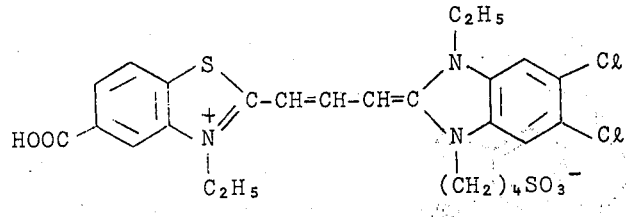

(II-K)
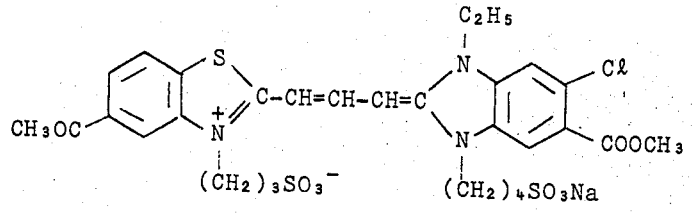
Examples of dyes of the general formula (III) are the following dyes.
(III-A)
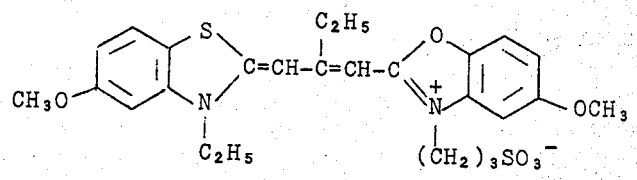
(III-B)
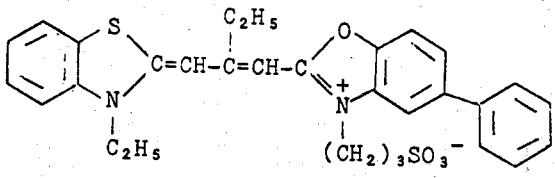
(III-C)
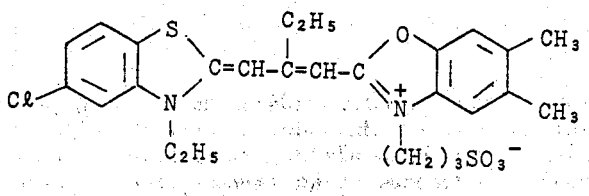
(III-D)
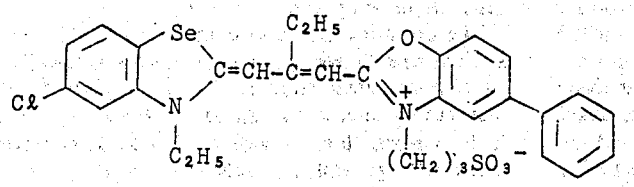
(III-E)
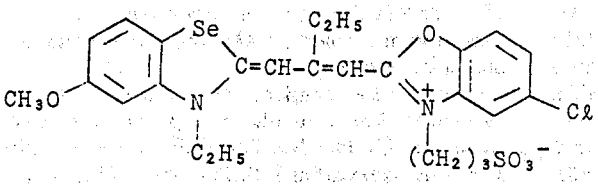

(III-F)

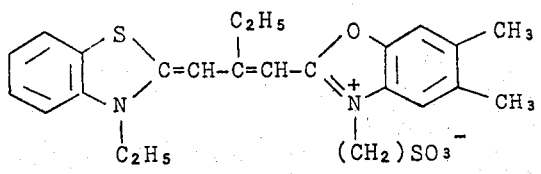

(III-G)

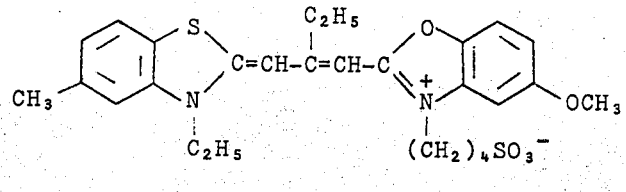

(III-H)

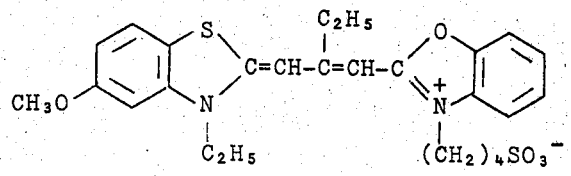

(III-I)

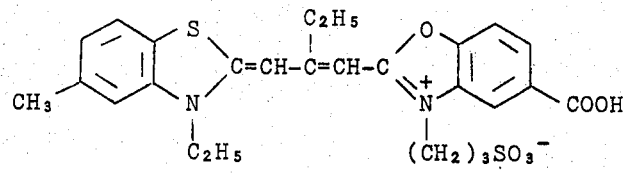

The silver halide photographic emulsion of this invention can be produced using conventional methods, and can contain silver chloride, silver bromide, silver iodide or mixed silver halide grains prepared, for example, using a single jet process, a double jet process or a combination of these processes. A preferred silver halide is silver iodobromide or silver chloroiodobromide (preferably contaning not more than about 10 mole% of iodide). The silver halide can be either in an ordinary particle size or in a fine particle size, but silver halide grains having an average diameter (measured, for example, by the projected area method and expressed as a number average) of about 0.04 $\mu$ to 2 $\mu$ are preferred.

The silver halide photographic emulsion of this invention can be sensitized using ordinary chemical sensitizing methods, such as by sensitization with gold (for example, as described in U.S. Pat. Nos. 2,540,085; 2,597,856; 2,597,915 and 2,399,083), sensitization with Group VIII metal ions, sensitization with sulfur (for example, as described in U.S. Pat. Nos. 1,574,944; 2,278,947; 2,440,206; 2,410,689; 3,189,458 and 3,415,649), and reduction sensitization (for example, as described in U.S. Pat. Nos. 2,518,698; 2,419,974 and 2,983,610), either alone or in combination.

Specifically, the silver halide photographic emulsion of this invention can contain a sulfur sensitizing agent such as allylthiocarbamide, thiourea, sodium thiosulfate or cystine, a noble metal sensitizing agent such as potassium chloroaurate, aurous thiosulfate or potassium chloropalladate, a reducing sensitizing agent such as stannous chloride, phenyl hydrazine or reductone, or a sensitizer such as a polyoxyethylene compound, a polyoxypropylene compound or a compound containing a quaternary ammonium group.

The emulsion can also contain an antifogging agent such as nitrobenzimidazole, or ammonium chloroplatinate, a stabilizer such as 4-hydroxy-6-methyl-1,3,3a,7-tetrazaindene, a hardening agent such as formaldehyde, chrom alum, 1-hydroxy-3,5-dichlorotriazine sodium salt, glyoxal, or dichloroacrolein, or a coating assistant such as saponin or a sodium alkylbenzenesulfonate.

When used in a color photographic material, the silver halide photographic emulsion of this invention can contain a color coupler and a dispersing agent for the color coupler.

Of the color couplers, cyan couplers are especially preferred. For example, the phenolic couplers disclosed in U.S. Pat. No. 2,698,794 or the naphthol-type couplers disclosed in U.S. Pat. No. 2,474,293 are especially useful.

The couplers disclosed in U.S. Pat. Nos. 2,600,788 and 3,062,653 or Japanese Patent Publication No. 6031/65, or the $\alpha$-naphthol-type cyan couplers or phenolic cyan couplers disclosed, for example, in U.S. Pat.

Nos. 3,311,476; 3,458,315; 3,214,437 and 3,253,924 can also be used.

Typical examples of colored couplers are those couplers disclosed in Japanese Patent Publication No. 2016/69, U.S. patent application Ser. No. 462,842, filed Apr. 22, 1974, and U.S. Pat. Nos. 3,476,560; 3,034,892; 3,386,301; 2,434,272 and 3,476,564.

Typical examples of DIR couplers are those disclosed in U.S. Pat. Nos. 3,148,062; 3,227,554; 3,701,783; 3,617,291; 3,770,436; and 3,622,328; Japanese Patent Publication No. 28836/70, Japanese Patent Publication No. 33233/70, and German OLS 2163811.

The silver halide photographic emulsion used in this invention can contain a protective colloid such as gelatin, an acylated gelatin (e.g., phthaloylated gelatin or malonated gelatin), a cellulose compound (e.g., hydroxyethyl cellulose or carboxymethyl cellulose), a soluble starch (e.g., dextrin), or a hydrophilic polymer (e.g., polyvinyl alcohol, polyvinyl pyrrolidone, polyacrylamide, or polystyrene sulfonic acid), a plasticizer for dimensional stability, a latex polymer, or a matting agent. The finished emulsion is coated on a suitable support, for example, baryta paper, a resin-coated paper, synthetic paper-like sheet, a cellulose triacetate film, a polyethylene terephthalate film, a glass sheet, or other plastic bases. A suitable coating amount of the silver halide emulsion can range from about $10^{-3}$ mol to $10^{-1}$ mol of silver halide per $m^2$ of the support.

The sensitizing dyes used in this invention can be added as aqueous solutions or solutions in a water-miscible organic solvent such as methanol, ethanol, methyl cellosolve or pyridine.

The amounts of the sensitizing dyes employed are those amounts usually suitable for supersensitization, for example, $5 \times 10^{-3}$ mol to $1 \times 10^{-6}$ mol of each of the sensitizing dyes per mol of silver. A preferred molar ratio of the dye of formula (II) or (III) to the dye of formula (I) is about 1:10 to 1:1.

The combination of the supersensitizing dyes in accordance with this invention can be used for sensitizing various silver halide photographic emulsions for color and black-white photographic materials. The emulsions of this invention can be, for example, color positive emulsions, color paper emulsions, color negative emulsions, color reversal emulsions (with or without couplers), emulsions for photographic materials for the graphic arts (for example, lithographic films), emulsions for cathode ray tube display recording photographic materials, emulsions for X-ray recording photographic materials (materials used for direct and indirect X-ray photography using an intensifying screen), emulsions for the colloid transfer process (disclosed, for example, in U.S. Pat. No. 2,716,059), emulsions for the silver salt diffusion transfer process (for example, as disclosed in U.S. Pat. Nos. 2,352,014; 2,543,181; 3,020,155 and 2,861,885), emulsions for the color diffusion transfer process (for example, as disclosed in U.S. Pat. Nos. 3,087,817; 3,185,567; 2,983,606; 3,253,915; 3,227,550; 3,227,551; 3,227,552; 3,415,644; 3,415,645 and 3,415,646), emulsions for the dye transfer process or imbibition transfer process (as disclosed, for example, in U.S. Pat. No. 2,882,156), emulsions for the silver dye bleaching method (as described in Friedman, *History of Color Photography*, American Photograhic Publishers, co., 1944, especially Chapter 24), emulsions for materials for recording print-out images (as disclosed, for example, in U.S. Pat. No. 2,369,449 and Belgian Patent No. 704,255), emulsions for direct print image photographic materials (for example, as disclosed in U.S. Pat. Nos. 3,033,682 and 3,287,137), emulsions for heat developable photographic materials (for example, as disclosed in U.S. Pat. Nos. 3,152,904; 3,312,550 and 3,148,122 and British Patent No. 1,110,046), and emulsions for physical development photographic materials (for example, as disclosed in British Patent Nos. 920,277 and 1,131,238).

Furthermore, the dyes in accordance with the present invention can be used for spectral sensitization using the methods disclosed in German Patent OLS No. 2,104,283 and U.S. Pat. No. 3,649,286.

The following Example is given to illustrate the present invention in detail, but the invention is not to be construed as being limited to this Example. Unless otherwise indicated, all parts, percents, ratios and the like are by weight.

EXAMPLE

A silver iodobromide (iodide content: 7 mol%) was prepared by precipitating silver halide grains using a conventional double jet process, and by physically ripening, desalting and chemically ripening the silver halide grains according to a conventional method disclosed in P. Glafkides, *Chimie et Physique Photographiques*, pp. 367 ~ 443, 1957.

The silver halide grains contained in this emulsion had an average diameter of 0.7 micron. One kilogram of this emulsion contained 0.52 mol of the silver halide. One kilogram of the emulsion was weighed and placed in a pot, and immersed in a constant temperature bath at 50°C to melt the emulsion.

Predetermined amounts of methanol solutions of each of the sensitizing dyes of this invention and methanol solutions of sensitizing dyes for comparison were added as shown in Table 1, and mixed respectively with the silver halide emulsion at 40°C with stirring to prepare emulsions. To each of the emulsions were further added 10 cc of a 0.1% by weight aqueous solution of 4-hydroxy-6-methyl-1,3,3a,7-tetrazaindene, 10 cc of a 1% by weight aqueous solution of 1-hydroxy-3,5-dichlorotriazine sodium salt, and 10 cc of a 1% by weight aqueous solution of sodium dodecylbenzenesulfonate, and the mixture was stirred. Each of the finished emulsions was coated on a cellulose triacetate film support in a dry coating thickness of 5 microns, and dried to form a sample of a photographic material. Each film sample was then cut into strips.

One of the strips was exposed through an optical wedge using a sensitometer having a light source with a color temperature of 5400°K to which were attached a blue filter (Sp-1) and a red filter (Sc-56) (products of Fuji Photo Film Co., Ltd.).

Another strip was exposed using a diffraction grating-type spectral photographic camera having a tungsten light source with a color temperature of 2,666°K in order to obtain a spectrogram.

Still another strip was exposed through an optical wedge using a diffraction grating-type strong Monochromater (Shimazu-Bausch & Lomb, a product of Shimazu Seisakusho Co., Ltd.) in order to obtain the sensitivity to monochromatic light at 580 nm.

Each of the strips was developed for 2 minutes at 20°C using a developer solution comprising 500 ml of water, 2.2 g of Metol, 96.0 g of anhydrous sodium sulfite, 8.8 g of hydroquinone, 56.0 g of sodium carbonate monohydrate, 5.0 g of potassium bromide, and additional water to make 1 liter, and then stopped, fixed and rinsed to obtain strips having black-and-white images. The densities of these photographs were measured using an S-type densitomer (a product of Fuji Photo Film Co., Ltd.) to determine the blue filter sensitivity (SB), the red filter sensitivity (SR), the monochromatic spectral sensitivity at 580 nm (S 580), and fog. The standard point of optical density for determining the sensitivities was the point of (fog + 0.2). The results obtained are shown in Table 1 as relative values. It is clear from these results that the combinations of supersensitizing dyes in accordance with this invention exhibit excellent results.

The effect obtained by the combination of the sensitizing dyes in accordance with this invention is not at all impaired even when these sensitizing dyes are further combined with a red-sensitive sensitizing dye.

The red-sensitive dyes which can be used in combination with the sensitizing dyes used in this invention can, for example, be expressed by the following general formula (IV)

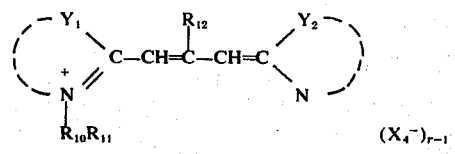

(IV)

wherein $Y_1$ and $Y_2$ each represents an atomic group -required to form a benzothiazole ring, a benzoselenazole ring or a naphthothiazole ring, which can be substituted with a substitutent that does not deteriorate the sensitivity (for example, the substituents described with respect to the general formulae (I) and (II)); $R_{10}$ and $R_{11}$ each represents an aliphatic group (for example, those described with respect to $R_1$ to $R_4$ in the general formulae (I) and (II)) at least one of which is preferably a sulfocontaining alkyl group, a carboxy-containing alkyl group or a hydroxyalkyl group; $R_{12}$ is a lower alkyl group such as a methyl or ethyl group or an aryl group such as a phenyl group; and $X_4$ and r are the same as $X_1$ and *m*, respectively, in the general formula (I). Some specific examples of these red-sensitive dyes are given below.

(A)

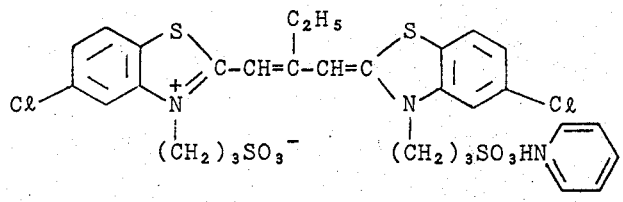

(B)

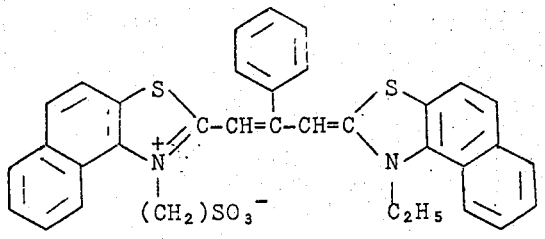

(C)

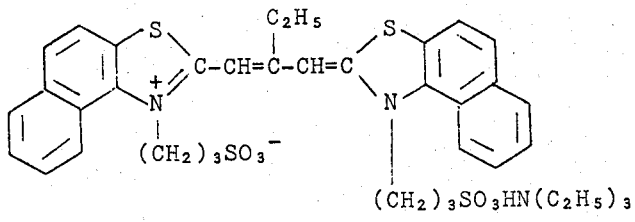

(D)

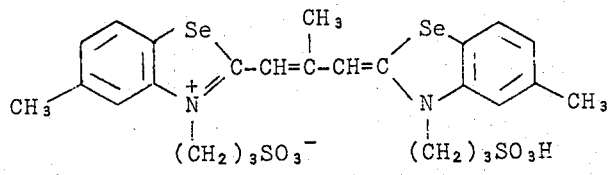

TABLE 1

Figure 2:
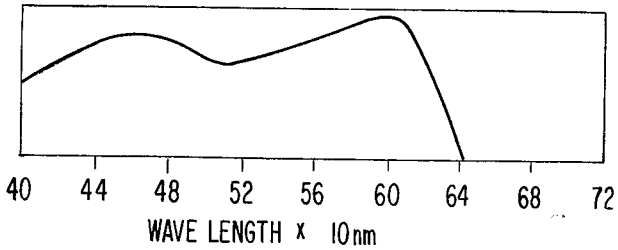
Figure 3:
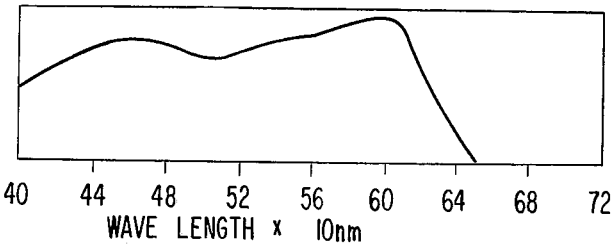
Figure 4:
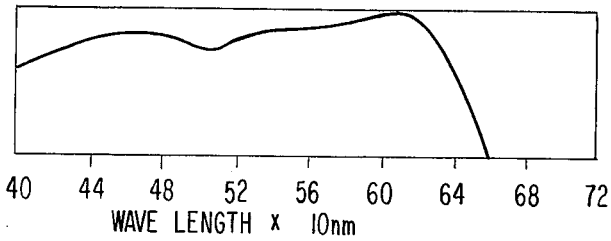
Figure 5:
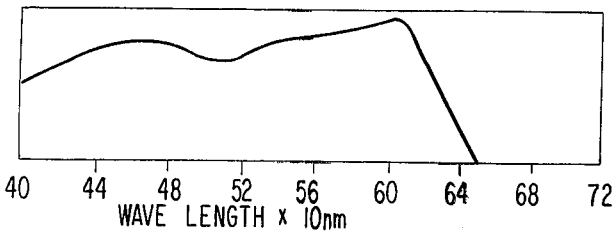
Figure 6:
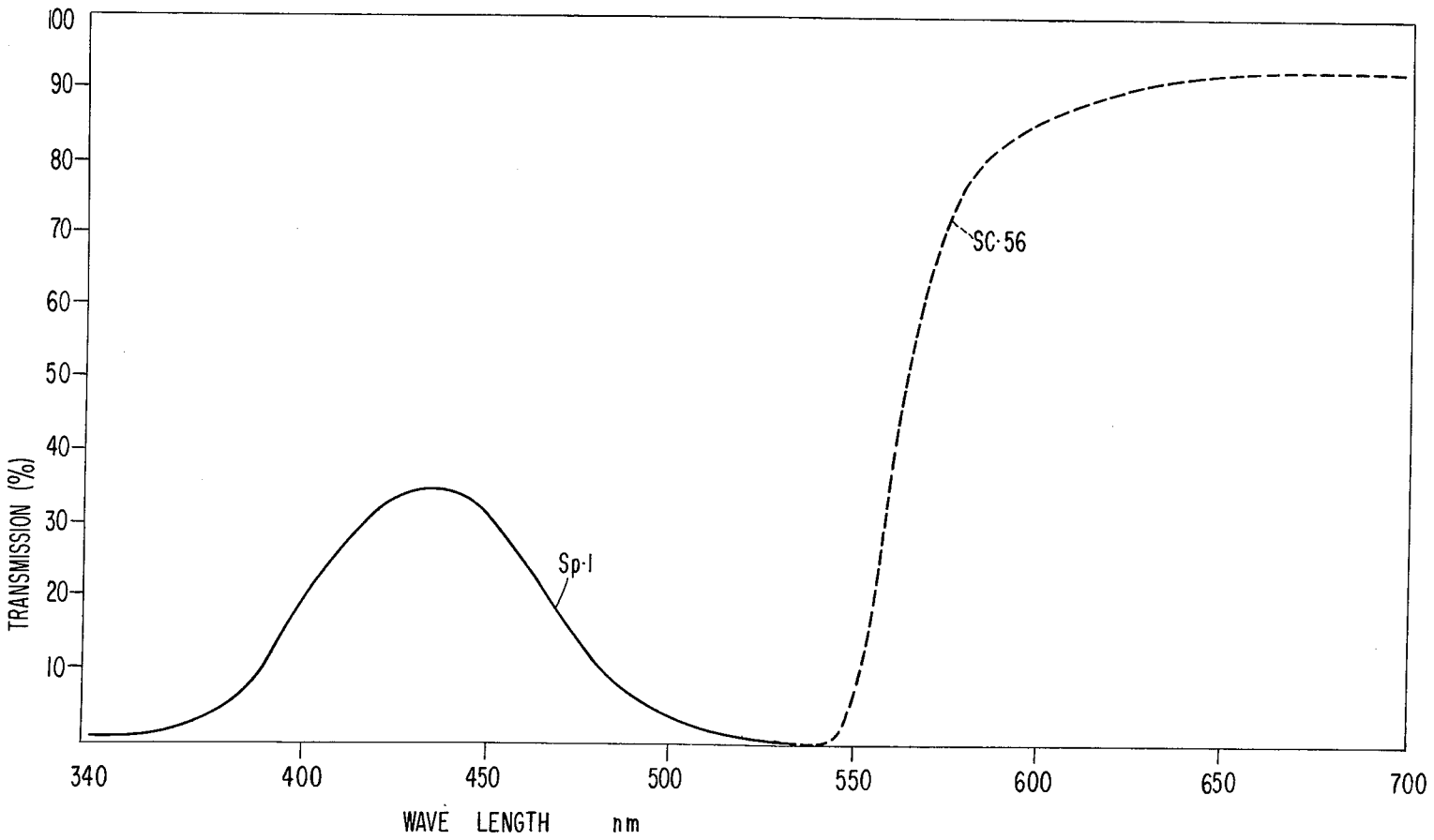
FIG. 6 shows the spectral percent transmission curves of filters Sp-1 and Sc-56 used in the Example.

| Run No. | Sensitizing Dye and Amount Added (× 10 $^{5}$ mol) | | | SR | SB | Fog | Residual Coloration** | Spectrogram |
|---|---|---|---|---|---|---|---|---|
| 1 | — | — | — | * | 100 | 0.05 | None | |
| | (I-A) 2 | — | — | 48 | 80 | 0.05 | None | |
| | 4 | — | — | 65 | 80 | 0.05 | None | |
| | 8 | — | — | 93 | 74 | 0.06 | Slight | |
| | — | (II-D) 2 | — | 10 | 33 | 0.05 | None | |
| | — | 4 | — | 13 | 21 | 0.05 | None | |
| | (I-A) 8 | (II-D) 2 | — | 138 | 64 | 0.06 | Slight | |
| | 8 | 4 | — | 138 | 64 | 0.07 | Slight | |
| 2 | (I-F) 2 | — | — | 70 | 83 | 0.05 | None | |
| | 4 | — | — | 100 | 83 | 0.05 | None | |
| | 8 | — | — | 126 | 79 | 0.05 | None | |
| | — | (II-A) 2 | — | 83 | 86 | 0.05 | None | |
| | — | 4 | — | 133 | 83 | 0.05 | None | |
| | (I-F) 8 | (II-A) 2 | — | 180 | 83 | 0.05 | None | |
| | 4 | 4 | — | 160 | 83 | 0.06 | None | FIG. 1 |
| 3 | (I-F) 8 | (II-A) 2 | (D) 1 | 220 | 86 | 0.05 | None | |
| | 8 | 2 | 2 | 235 | 86 | 0.06 | Slight | |
| 4 | (I-F) 8 | (II-D) 2 | — | 180 | 77 | 0.05 | None | |
| | 8 | 4 | — | 138 | 69 | 0.05 | None | FIG. 2 |
| 5 | — | (II-C) 2 | — | 32 | 93 | 0.05 | None | |
| | — | 4 | — | 48 | 86 | 0.05 | None | |
| | — | 8 | — | 72 | 77 | 0.07 | Slight | |
| | (I-F) 8 | (II-C) 2 | — | 144 | 80 | 0.05 | None | |
| | 8 | 4 | — | 152 | 66 | 0.05 | None | |
| 6 | (I-H) 2 | — | — | 80 | 83 | 0.05 | None | |
| | 4 | — | — | 108 | 83 | 0.05 | None | |
| | 8 | — | — | 157 | 77 | 0.05 | None | |
| | (I-B) 8 | (II-A) 2 | — | 180 | 77 | 0.05 | None | |
| | 4 | 4 | — | 172 | 83 | 0.06 | None | |
| 7 | — | (III-A) 2 | — | 108 | 77 | 0.05 | None | |
| | — | 4 | — | 132 | 75 | 0.05 | None | |
| | — | 8 | — | 158 | 65 | 0.05 | None | |
| | (I-F) 2 | (III-A) 8 | — | 180 | 67 | 0.05 | None | |
| | 4 | 4 | — | 180 | 75 | 0.05 | None | FIG. 3 |
| 8 | (I-F) 4 | (III-A) 4 | (B) 0.5 | 180 | 75 | 0.06 | Slight | |
| | 4 | 4 | (B) 1 | 190 | 75 | 0.07 | Slight | FIG. 4 |
| 9 | (I-E) 2 | — | — | 80 | 90 | 0.05 | None | |
| | 4 | — | — | 112 | 83 | 0.05 | None | |
| | (I-E) 4 | (III-A) 2 | — | 190 | 80 | 0.05 | None | |
| | 4 | 4 | — | 198 | 80 | 0.05 | None | FIG. 5 |
| 10 | (I-E) 4 | (III-A) 4 | (A) 1 | 220 | 86 | 0.06 | Slight | |
| 11 | (I-E) 4 | (III-A) 4 | (C) 0.5 | 220 | 80 | 0.05 | None | |
| 12 | — | (III-F) 2 | — | 7 | 97 | 0.05 | None | |
| | — | 4 | — | 13 | 86 | 0.05 | None | |
| | — | 8 | — | 21 | 80 | 0.06 | None | |
| | (I-E) 4 | (III-F) 2 | — | 150 | 83 | 0.05 | None | |
| | 4 | 4 | — | 150 | 83 | 0.05 | None | |
| 13 | — | (III-B) 2 | — | 86 | 90 | 0.05 | None | |
| | — | 4 | — | 110 | 86 | 0.05 | None | |
| | — | 8 | — | 126 | 80 | 0.06 | Slight | |
| | (I-H) 4 | (III-B) 4 | — | 153 | 86 | 0.06 | None | |
| | 4 | 8 | — | 180 | 86 | 0.06 | Slight | |

*Too low to measure
**Residual Coloration: Slight > None

The combination of sensitizing dyes having supersensitizing effects in accordance with this invention is useful for spectral sensitization of silver halide emulsions for red-sensitive layers of color photographic materials, such as color negative photographic materials or color reversal photographic materials, silver halide emulsions for lithographic photographic materials, and silver halide emulsions for photographic materials to be subjected to microsecond exposure, especially CRT photographic materials or photographic materials for holography, or photographic materials used in facsimile systems.

When the photographic emulsion of this invention is used for color photographic materials, it is preferred to provide a magenta or red external filter above, or adjacent, the red-sensitive silver halide emulsion layer obtained by the present invention in order to reduce the green sensitivity of the emulsion as compared with the red sensitivity of the emulsion. In order to form this filter layer, the dyes disclosed, for example, in Japanese Patent Publication Nos. 18459/66. 13168/68, 3504/68 and 22069/64, Japanese Patent Application No. 98474/71, and U.S. Pat. Nos. 3,440,051; 3,540,887; 3,615,546; 3,468,883; 3,294,539; 3,379,533; 3,352,680; 3,389,994; 3,384,487; 3,423,207; 3,493,375; 3,486,897; 3,481,927; 3,497,502; 3,573,289; 3,560,214; 3,615,432 and 3,282,699; and British Patent No. 506,385 can be used. In particular, dyes which selectively absorb light of wavelengths shorter than 570 nm are useful. Furthermore, the processes disclosed in U.S. Pat. Nos. 3,425,834; 3,282,699; 3,469,987; 3,455,693; 3,392,022; 3,502,474; 3.512.983; 3,594,171; 3,445,231 and 3,672,898 and Belgian Patent No. 627,308 can be used. These dyes can also be used in order to prevent irradiation or halation.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing, in combination, supersensitizing amounts of (A) at least one sensitizing dye of the following general formula (I)

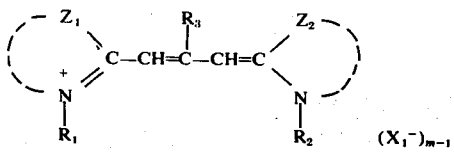

(I)

wherein $Z_1$ represents an atomic group required to form a benzimidazole ring; $Z_2$ represents an atomic group required to form a benzoselenazole ring; $R_1$ and $R_2$ each represents an aliphatic group, with at least one of $R_1$ and $R_2$ being a carboxy-containing alkyl group or a sulfo-containing alkyl group; $R_3$ is a hydrogen atom or an alkyl group; $X_1$ is an acid anion; and $m$ is 1 or 2, and when $m$ is 1 the dye forms an intramolecular salt; and (B) at least one sensitizing dye selected from the group consisting of a sensitizing dye of the following general formula (II)

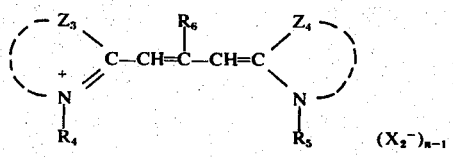

(II)

wherein $Z_3$ represents an atomic group required to form a benzothiazole ring, a $\beta$-naphthothizole ring or a 62-naphthoselenazole ring; $Z_4$ represents an atomic group required to form a benzimidazole ring; $R_4$ and $R_5$ each represents an aliphatic group, with at least one of $R_4$ and $R_5$ being a carboxy-containing alkyl group or a sulfo-containing alkyl group; $R_6$ is a hydrogen atom or an alkyl group; $X_2$ is an acid anion; and $n$ is 1 or 2, and when $n$ is 1 the dye forms an intramolecular salt; and a sensitizing dye of the following general formula (III)

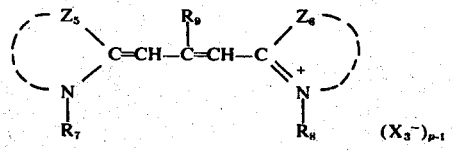

(III)

wherein $Z_5$ represents an atomic group required to form a benzothiazole ring or a benzoselenazole ring; $Z_6$ represents an atomic group required to form a benzoxazole ring; $R_7$ and $R_8$ each represents an aliphatic group, with at least one of $R_7$ and $R_8$ being a carboxy-containing alkyl group or a sulfo-containing alkyl group; $R_9$ is a hydrogen atom or an alkyl group; $X_3$ is an acid anion; and $p$ is 1 or 2, and when $p$ is 1 the dye forms an intramolecular salt.

2. The silver halide photographic emulsion of claim 1, wherein the molar ratio of the sensitizing dye of the general formula (II) or of the general formula (III) to the sensitizing dye of the general formula (I) is 1:10 to 1:1.

3. The silver halide photographic emulsion of claim 1, wherein the heterocyclic ring formed by $Z_1$ is a benzoimidazole ring unsubstituted at the 5- and 6-positions or substituted with a chlorine atom at at least one of the 5- and 6-positions; and $R_3$ is a hydrogen atom.

4. The silver halide photographic emulsion of claim 1, wherein the heterocyclic ring formed by $Z_4$ is a benzimidazole ring unsubstituted at the 5- and 6-position or substituted with a chlorine atom at at least one of the 5- and 6-positions; and $R_6$ is a hydrogen atom.

5. The silver halide photographic emulsion of claim thereon wherein the heterocyclic ring formed by $Z_3$ is a benzothiazole ring unsubstituted at the 5-position or substituted at the 5-position with a methoxy group, a methyl group, a phenyl group or a chlorine atom.

6. The silver halide photographic emulsion of claim 1, wherein the heterocyclic ring formed by $Z_5$ is a benzothiazole or benzoselenazole ring unsubstituted at the 5-position or substituted at the 5-position with a methyl group, a methoxy group, a phenyl group or a chlorine atom; the heterocyclic ring formed by $Z_6$ is a benzoxazole ring unsubstituted at the 5-position or substituted at the 5-position with a methyl group, a methoxy group, a phenyl group or a chlorine atom; and at least one of $R_7$ and $R_8$ is a sulfoalkyl group or a carboxyalkyl group.

7. The silver halide photographic emulsion of claim 1, wherein at least one of $R_1$ and $R_2$ is a sulfoalkyl group or a carboxyalkyl group.

8. The silver halide photographic emulsion of claim 1, wherein at least one of $R_4$ and $R_5$ is a sulfoalkyl group or a carboxyalkyl group.

9. The silver halide photographic emulsion of claim 1, wherein the heterocyclic ring formed by $Z_4$ is a benzimidazole ring unsubstituted at the 5- and 6-position or substituted with a chlorine atom at at least one of the 5- and 6-positions; and $R_6$ is a hydrogen atom and the heterocyclic ring formed by $Z_3$ is a benzothiazole ring unsubstituted at the 5-position or substituted at the 5-position with a methoxy group, a methyl group, a phenyl group or a chlorine atom.

10. A photographic material comprising a support having thereof the silver halide photographic emulsion of claim 1.

* * * * *